US011970943B2

(12) United States Patent
Alhelal

(10) Patent No.: US 11,970,943 B2
(45) Date of Patent: Apr. 30, 2024

(54) FLOAT SHOE/COLLAR WITH A BREAKABLE DISK

(71) Applicant: SAUDI ARABIAN OIL COMPANY, Dhahran (SA)

(72) Inventor: Mohammed Ali Alhelal, Al Mubarraz (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 223 days.

(21) Appl. No.: 17/710,266

(22) Filed: Mar. 31, 2022

(65) Prior Publication Data

US 2023/0313617 A1 Oct. 5, 2023

(51) Int. Cl.
*E21B 7/20* (2006.01)
*E21B 34/06* (2006.01)
*E21B 34/14* (2006.01)

(52) U.S. Cl.
CPC ..... *E21B 7/20* (2013.01); *E21B 34/063* (2013.01); *E21B 34/14* (2013.01); *E21B 2200/05* (2020.05)

(58) Field of Classification Search
CPC ..... E21B 7/20; E21B 34/063; E21B 34/14; E21B 2200/05
USPC ..... 166/332.8
See application file for complete search history.

(56) References Cited

U.S. PATENT DOCUMENTS 1,882,314 A 10/1932 Burt
1,937,188 A 11/1933 Bloss
3,768,562 A 10/1973 Baker
4,286,664 A 9/1981 Bolding, Jr.
4,532,995 A 8/1985 Kaufman
5,680,905 A * 10/1997 Green ..... E21B 43/11852 175/4.54
6,505,685 B1 1/2003 Sullaway et al.
11,125,048 B1 * 9/2021 Giroux ..... E21B 33/146
2003/0070815 A1 4/2003 Sullaway et al.
2015/0068730 A1 * 3/2015 Frazier ..... E21B 34/063 166/181
2015/0136395 A1 * 5/2015 Turley ..... E21B 33/13 166/65.1
2021/0047898 A1 * 2/2021 Garcia ..... E21B 33/165
2021/0071500 A1 3/2021 Hoffman
2023/0265735 A1 * 8/2023 Wright ..... E21B 47/117 166/387
2023/0287759 A1 * 9/2023 Polo Terán ..... E21B 41/0035

* cited by examiner

*Primary Examiner* — Matthew R Buck
*Assistant Examiner* — Patrick F Lambe
(74) *Attorney, Agent, or Firm* — Osha Bergman Watanabe & Burton LLP

(57) ABSTRACT

A system includes a casing string, a flow control apparatus, and a stinger. The flow control apparatus includes a tubular body, a float valve, and a disk. The tubular body has a conduit and a first end. The first end is connectable to the casing string. The float valve is fixed within the conduit of the tubular body and is configured to block flow in a first direction and allow flow in the second direction. The disk is fixed above the float valve and within the conduit of the tubular body. The disk is configured to prevent flow in the second direction until the disk is broken by a pre-determined force. The stinger is deployed in the casing string and applies the pre-determined force to the disk to allow a flow of the fluid, in the second direction, from the stinger to the annulus.

20 Claims, 5 Drawing Sheets

FLOAT SHOE/COLLAR WITH A BREAKABLE DISK

BACKGROUND

In the oil and gas industry, hydrocarbons are located in porous formations far beneath the Earth's surface. Wells are drilled into these formations to access and produce said hydrocarbons. A well is a structure formed by a wellbore and supported by at least one casing string cemented in the wellbore. A casing string is made of a plurality of joints of casing connected together. The primary concern while drilling a well is well control, that is, preventing an uncontrolled release of hydrocarbons to the Earth's surface.

As such, casing strings often have at least one float valve installed in the float shoe or the float collar of the casing string. The float valve is a check valve that only allows a flow of fluid in one direction. In terms of the casing string and the wellbore, the float valve only allows the flow of fluid from the inside of the casing string to the wellbore. The wellbore is filled with a drilling fluid prior to the casing string being run into the wellbore, thus the casing string must overcome a buoyant force in order to be lowered to the bottom of the wellbore.

Because the bottom of the casing string is blocked with the float valve, fluid is unable to enter the casing string from the wellbore, as such, the casing string is often filled with fluid from the surface to weight up the casing string and aid in overcoming the buoyant force. However, due to the float valve allowing fluid to migrate from the inside of the casing string to the wellbore, the fluid entering the casing string from the surface will exit out the bottom of the casing string to the wellbore. This prevents the casing string from being completely filled with the fluid which, in turn, makes it difficult to overcome the buoyancy force and run the casing string to the bottom of the wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, one or more embodiments relate to systems and methods for placing a fluid in an annulus of a well. In accordance with one or more embodiments, the system includes a casing string, a flow control apparatus, and a stinger. The casing string has a casing outer circumferential surface. The casing outer circumferential surface delineates a boundary of the annulus. The flow control apparatus includes a tubular body, a float valve, and a disk. The tubular body has a conduit delineated by a tubular inner circumferential surface, a first end, and a second end. The first end is connectable to the casing string and the conduit comprises a hydraulic connection with the annulus in a second direction. The float valve is fixed within the conduit of the tubular body and is configured to block flow in a first direction and allow flow in the second direction. The disk is fixed above the float valve and within the conduit of the tubular body. The disk is configured to prevent flow in the second direction until the disk is broken by a pre-determined force. The stinger is deployed in the casing string by a deployment device and has a bottom end with an outer diameter smaller than a diameter of the conduit. The stinger applies the pre-determined force to the disk to allow a flow of the fluid, in the second direction, from the stinger to the annulus.

In accordance with one or more embodiments, the method includes providing a casing string having a casing outer circumferential surface that delineates a boundary of the annulus. The casing string has a flow control apparatus. The flow control apparatus has a tubular body, a float valve, and a disk. The tubular body has a conduit delineated by a tubular inner circumferential surface, a first end, and a second end. The first end is connectable to the casing string and the conduit comprises a hydraulic connection with the annulus in a second direction. The float valve is fixed within the conduit of the tubular body and is configured to block flow in a first direction and allow flow in the second direction. A disk is fixed above the float valve and within the conduit of the tubular body. The disk is configured to prevent flow in the second direction until the disk is broken by a pre-determined force. The method further includes filling the casing string with a fluid while running the casing string into the well, running a stinger using a deployment device into the conduit of the tubular body, applying the pre-determined force to the disk to break the disk using the stinger, and pumping a fluid in the second direction from the stinger to the annulus.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Figure 1:
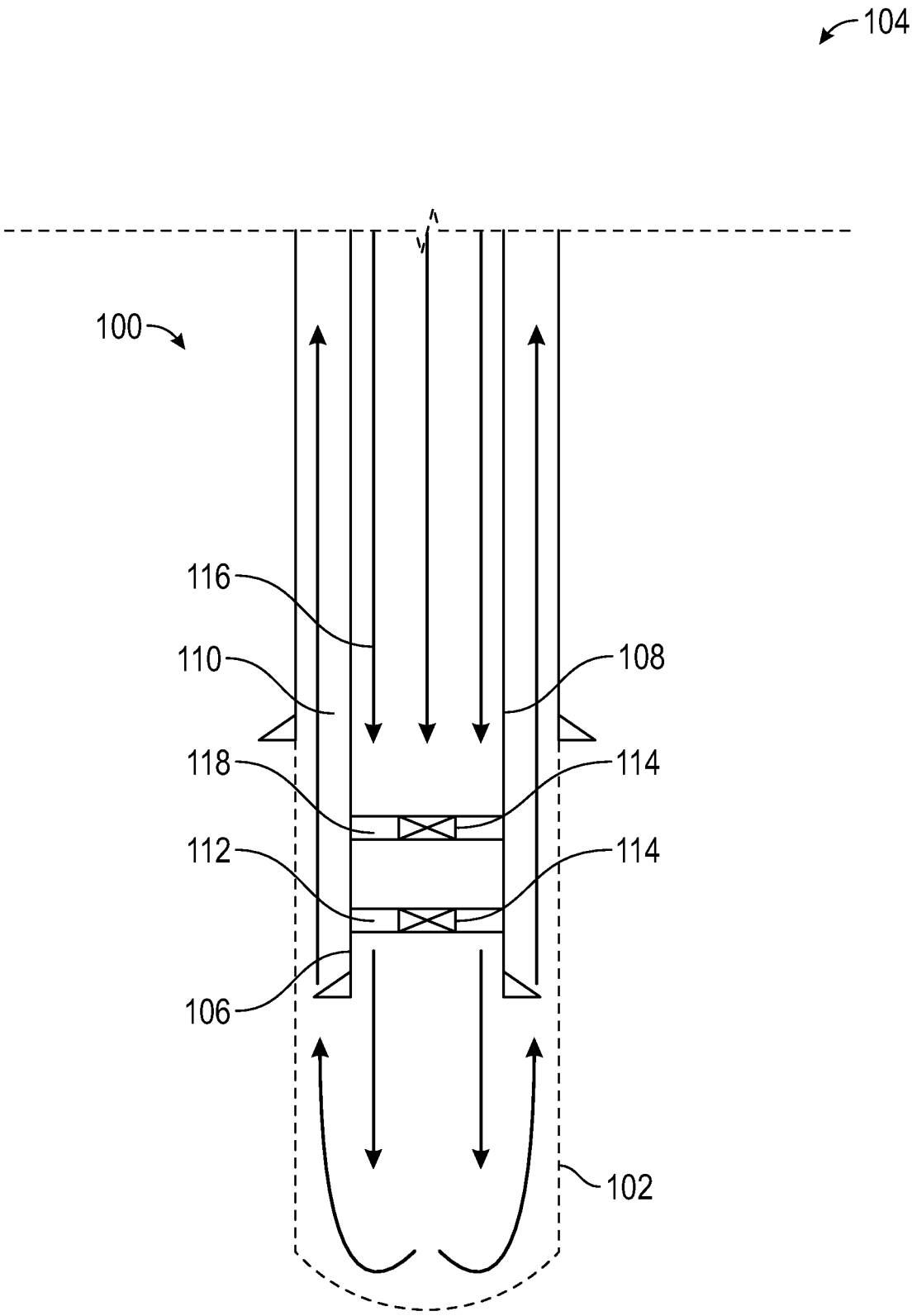
FIG. 1 shows an exemplary well in accordance with one or more embodiments.

FIG. 1 shows an exemplary well (100) in accordance with one or more embodiments. The well (100) includes a wellbore (102) drilled into the surface of the Earth. The wellbore (102) is a hole, drilled into the surface of the Earth, delineated by underground rock formations. The underground rock formations may or may not be filled with hydrocarbons. The wellbore (102) extends to a surface location (104). The surface location (104) is any location located along or above the surface of the Earth. The well (100) has a casing string (106) located within the wellbore (102).

A casing string (106) is made of a plurality of joints of casing connected together. Each joint of casing is a tubular made of a durable material, such as steel. The casing joints may also be made of a lighter material, such as fiberglass. The casing string (106) has a casing outer circumferential surface (108). The casing outer circumferential surface (108) delineates a boundary of an annulus (110). The annulus (110) is the space located between the casing outer circumferential surface (108) and the wellbore (102). Because wells (100) are often supported by a plurality of casing strings, the annulus (110) may also include the space located between the casing outer circumferential surface (108) and a shallower casing string's inner circumferential surface.

The casing string (106) is shown having a float shoe (112). A float shoe (112) is the portion of the casing string (106) located furthest away from the surface location (104), i.e., the deepest component of the casing string (106) in a vertical well (100). A float shoe (112) is a rounded profile component. The rounded profile allows the casing string (106) to guide the casing string (106) towards the center of the wellbore (102) to minimize hitting rock ledges and washouts. The float shoe (112) may include a float valve (114) located on the inside of the float shoe (112).

The float valve (114) is a check valve that only allows a flow of fluid (116) in one direction. In terms of the casing string (106) and the wellbore (102), the float valve (114) only allows the flow of fluid (116) from the inside of the casing string (106) to the wellbore (102) and to the annulus (110). The float shoe (112) may also include a profile for a cement plug to land out. The outer portion of the float shoe (112) may be made of a durable material, such as steel, and may match the size of the casing string (106). The inner components of the float shoe (112), including the float valve (114), are made of a drillable material, such as cement or thermoplastic.

The casing string (106) of the well (100) is shown as also having a float collar (118). The float collar (118) is also located along a portion of the casing string (106) further away from the surface location (104); however, the float collar (118) is located at a shallower depth than the float shoe (112), i.e., the float collar (118) is closer to the surface location (104) than the float shoe (112). The float collar (118) may also have a float valve (114) and a profile for a cement plug to land out. The outer portion of the float collar (118) may be made of a durable material, such as steel, and may match the size of the casing string (106). The inner components of the float collar (118), including the float valve (114), are made of a drillable material, such as cement or thermoplastic.

A casing string (106) is commonly made with both a float shoe (112) and a float collar (118), and both the float shoe (112) and the float collar (118) have float valves (114). This is a redundancy in case one of the float valves (114) fails. However, a casing string (106) may be made of only a float shoe (112) or a float collar (118) and there may be only one float valve (114) without departing from the scope of this disclosure herein. FIG. 1 shows a fluid (116) being circulated in the well (100). The fluid (116) may be a drilling mud, a spacer, a cement slurry, etc. The fluid (116) is pumped from the surface location (104) into the interior of the casing string (106). The fluid (116) is pumped out the float shoe (112) and into the wellbore (102). The fluid (116) is pumped up the annulus (110) towards the surface location (104). Because of the float valves (114), the fluid (116) is unable to flow from the annulus (110)/wellbore (102) back into the casing string (106).

The wellbore (102) is filled with a fluid (116) prior to the casing string (106) being run into the wellbore (102). In order for the casing string (106) to reach its setting point (i.e., the bottom of the wellbore (102)), the casing string (106) must overcome the buoyancy forces exerted by the fluid (116). When the weight of the casing string (106) is not heavy enough to overcome the buoyancy force, the casing string (106) is filled with fluid (116) from the surface location (104) to weight up the casing string (106) as the casing string (106) is being lowered into the wellbore (102). However, due to the float valve (114) allowing fluid (116) to migrate from the inside of the casing string (106) to the wellbore (102), the fluid (116) entering the casing string (106) from the surface location (104) may exit out the bottom of the casing string (106) to the wellbore (102).

This prevents the casing string (106) from being completely filled with the fluid (116) which, in turn, makes it difficult to overcome the buoyancy force and run the casing string (106) to the bottom of the wellbore (102). Therefore, systems that allow the casing string (106) to be filled with a fluid (116), without allowing the fluid (116) to exit the casing string (106), are beneficial. As such, embodiments disclosed herein present systems and methods using a flow control apparatus that allows a casing string (106) to be filled with a fluid (116) while lowering the casing string (106) into the wellbore (102).

Figure 2:
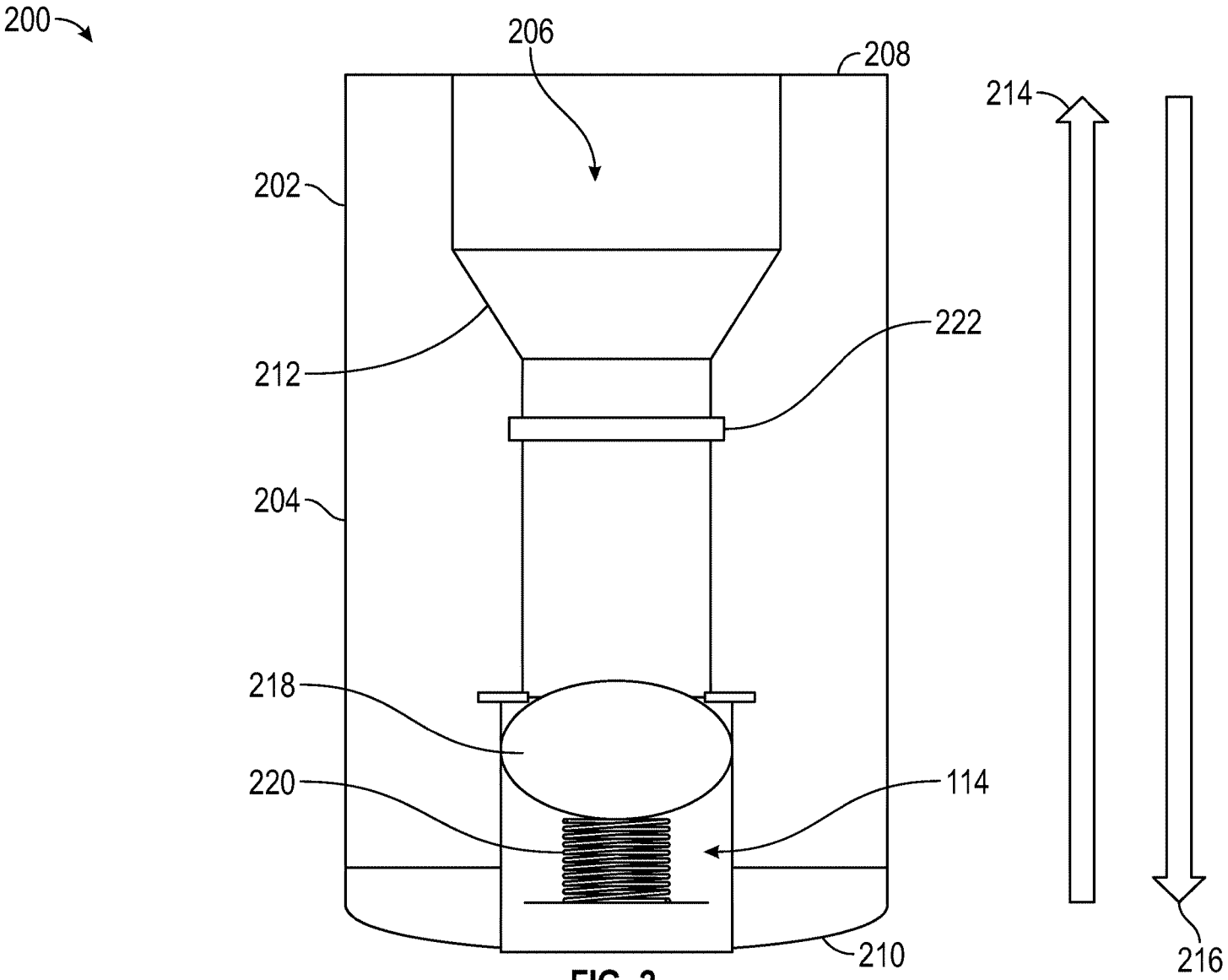
FIG. 2 shows a flow control apparatus in accordance with one or more embodiments.

FIG. 2 shows a flow control apparatus (200) in accordance with one or more embodiments. The flow control apparatus (200) is made of a tubular body (202) having a tubular outer circumferential surface (204). The tubular body (202) has a conduit (206) that extends from a first end (208) of the tubular body (202) to a second end (210) of the tubular body (202). The conduit (206) is delineated by a tubular inner circumferential surface (212).

The first end (208) is connectable to a casing string (106), such as the casing string (106) depicted in FIG. 1. The first end (208) may be connected to the casing string (106) by any means known in the art, such as a thread-able connection. In other embodiments, the second end (210) may also be connectable to a casing string (106) by a thread-able connection. When only the first end (208) is connectable to the casing string (106), then the flow control apparatus (200) may act as a float shoe (112) as described in FIG. 1. When both the first end (208) and the second end (210) are connectable to the casing string (106), then the flow control apparatus (200) may act as a float collar (118) as described in FIG. 1.

The conduit (206) has a hydraulic connection with an external environment. The external environment may be the wellbore (102) and annulus (110) as depicted in FIG. 1. The flow control apparatus (200) further includes a float valve (114) fixed within the conduit (206) of the tubular body (202). The float valve (114) may be fixed within the conduit (206) closer to the second end (210) of the tubular body (202) rather than the first end (208) of the tubular body (202). The float valve (114) may be a float valve (114) as depicted in FIG. 1. The float valve (114) blocks flow in a first direction (214) and allows flow in a second direction (216). The first direction (214) is defined as the direction from the second end (210) to the first end (208) of the tubular body (202). The second direction (216) is defined as the direction from the first end (208) to the second end (210) of the tubular body (202).

The float valve (114) may be configured to block flow in the first direction (214) and allow flow in the second direction (216) by using a flap (218) connected to a spring (220). The flap (218) may naturally be in a closed position due to the spring (220). When a fluid (116) exerts a force on the flap (218) from the second direction (216), the force compresses the spring (220) allowing the flap (218) to be opened. However, when the fluid (116) exerts a force on the flap (218) from the first direction (214), the force is unable to be transferred to the spring (220) and the flap (218) remains in the closed position.

A disk (222) is fixed within the conduit (206) of the tubular body (202). The disk (222) prevents flow in the second direction (216). The disk (222) is fixed between the float valve (114) and the first end (208) of the tubular body (202). The disk (222) extends completely across the conduit (206) to divide the conduit (206) into two portions that are no longer hydraulically connected to one another. The disk (222) is solid and prevents fluid (116) from passing through the disk and through the conduit (206) in either the first direction (214) or the second direction (216). The disk (222) is designed to be broken by a pre-determined force. The pre-determined force may be applied using a stinger or by applying a hydraulic pressure on the disk (222). When the disk (222) is broken by the pre-determined force, flow is permitted in the second direction (216) through the conduit (206), and flow in the first direction (214) is still prevented by the float valve (114).

The disk (222) is made of a drillable/fragile material that can be easily broken by the pre-determined force, such as ceramic. The interior components of the flow control apparatus (200) including the float valve (114) and a portion of the tubular body (202) located between the tubular inner circumferential surface (212) and the tubular outer circumferential surface (204) are made of a drillable material, such as cement or thermoplastic. The tubular outer circumferential surface (204) is made of a durable material, such as steel.

Figure 3:
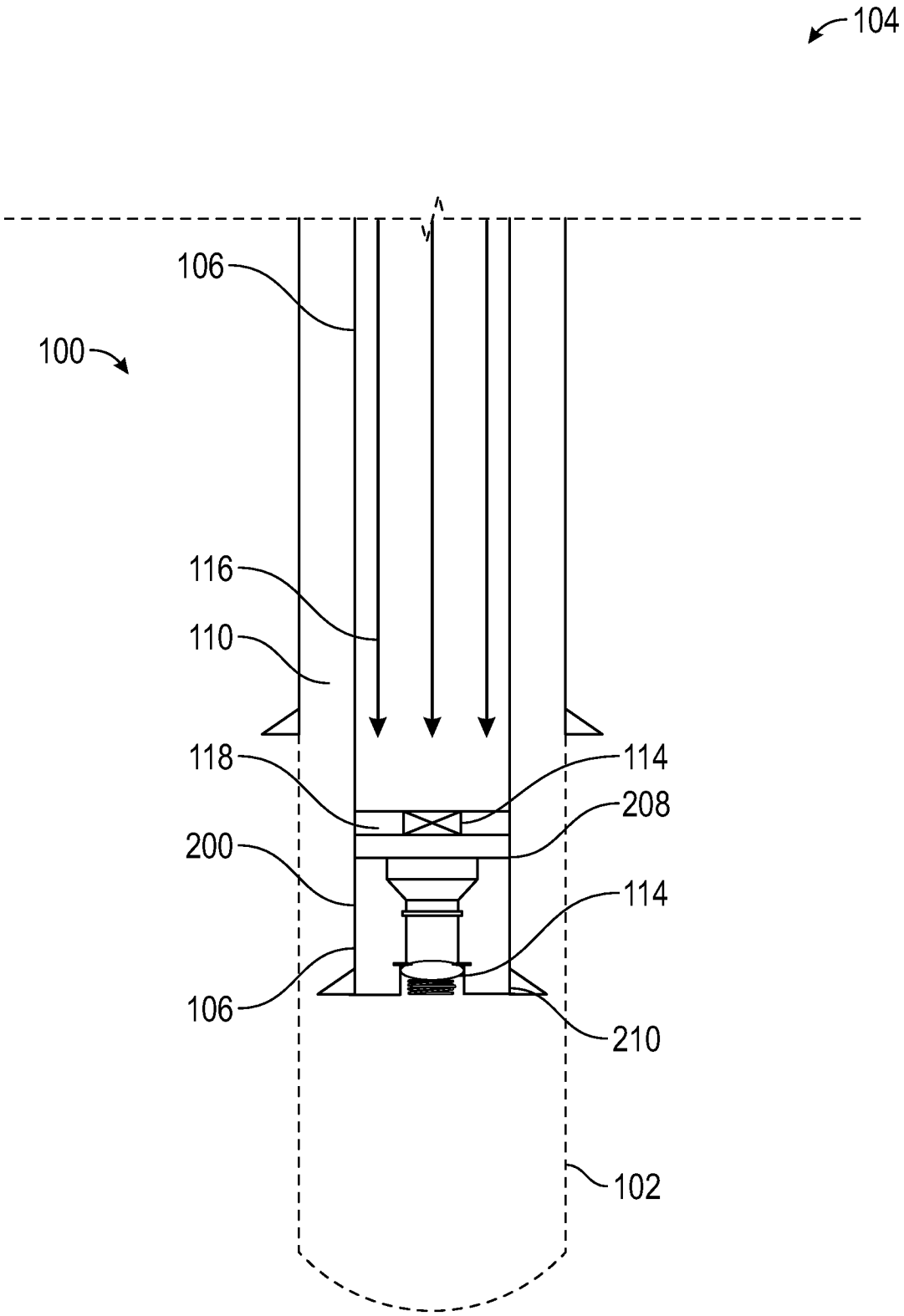
FIG. 3 shows a system incorporating the flow control apparatus in accordance with one or more embodiments.

FIG. 3 shows a system incorporating the flow control apparatus (200) in accordance with one or more embodiments. Specifically, FIG. 3 shows the well (100), as depicted in FIG. 1, using the flow control apparatus (200), as depicted in FIG. 2, as the float shoe (112). Components of FIG. 3 that are the same as or similar to components depicted in FIGS. 1 and 2 have not been redescribed for purposes of readability and have the same functions as described above.

The flow control apparatus (200) is installed in the casing string (106) below the float collar (118). That is, the float collar (118) is closer to the surface location (104) than the flow control apparatus (200). The flow control apparatus (200) is the component of the casing string (106) located furthest away from the surface location (104). The flow control apparatus (200) is shown as having the first end (208) of the tubular body (202) connected to the casing string (106). The second end (210) of the tubular body (202) is located further way from the surface location (104) than the first end (208) of the tubular body (202).

The casing string (106) shown in FIG. 3 may be in the process of being lowered into the wellbore (102) and the casing string (106) is being filled with a fluid (116) from the surface location (104). As the flow control apparatus (200) has the disk (222), unbroken, the fluid (116) is unable to pass through the conduit (206) and out into the wellbore (102) and annulus (110). Thus, the casing string (106) is able to be filled with fluid (116) to overcome the buoyancy force.

Figure 4B:
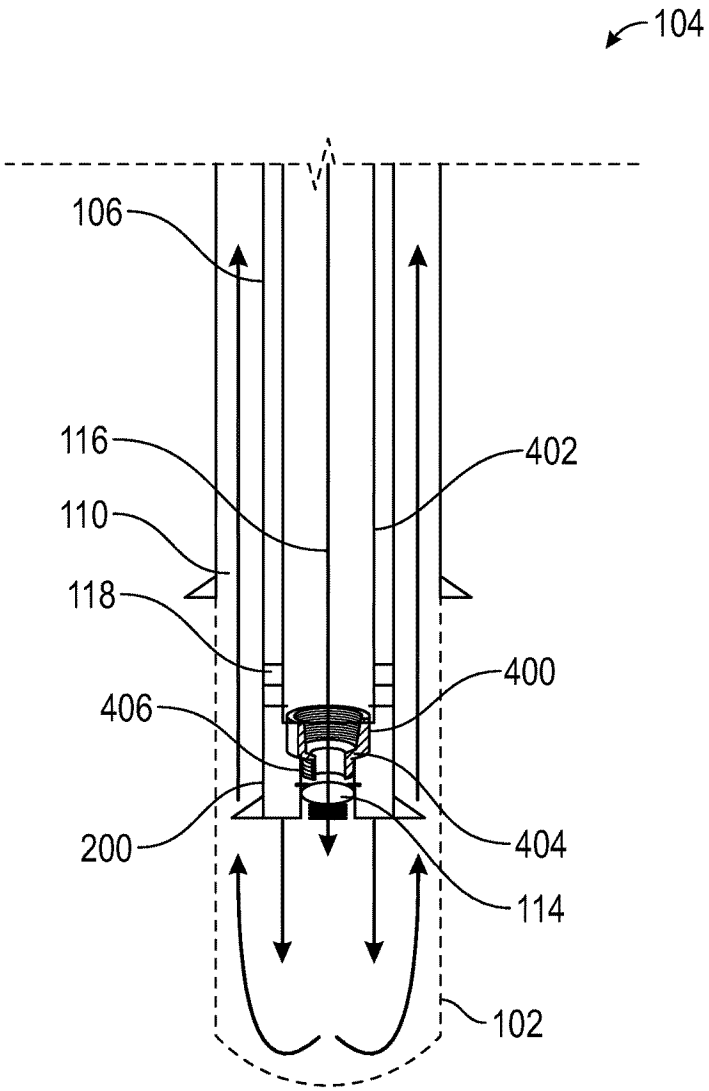
FIGS. 4*a* and 4*b* show a system incorporating the flow control apparatus in accordance with one or more embodiments.
Figure 4A:
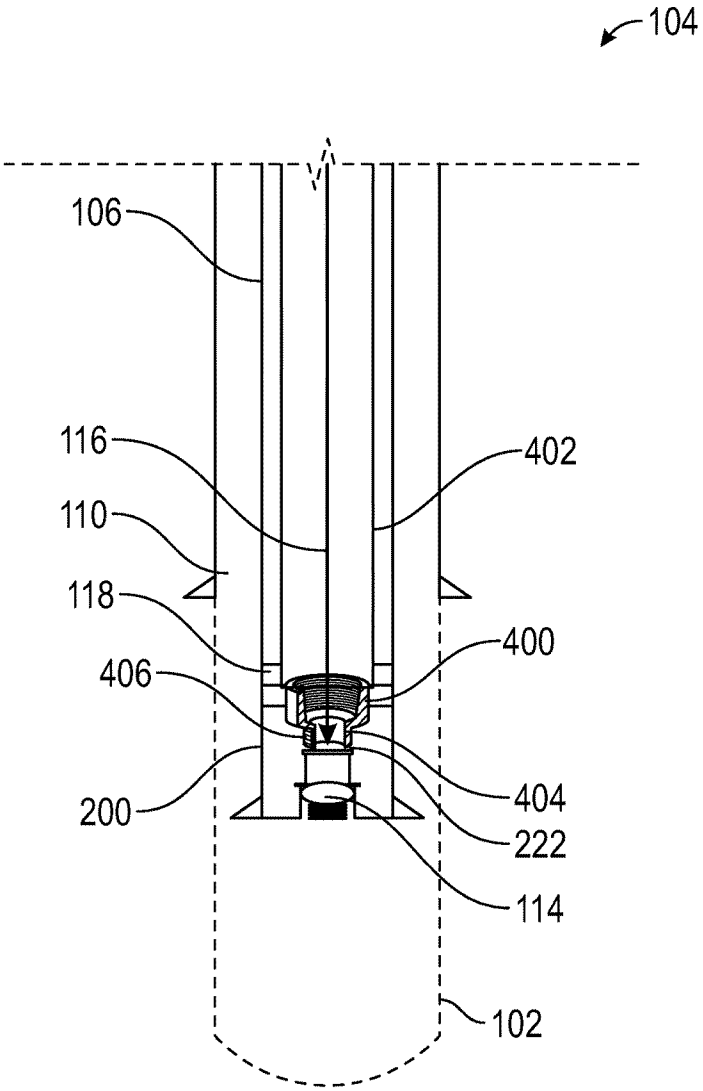

FIGS. 4*a* and 4*b* show a system incorporating the flow control apparatus (200) in accordance with one or more embodiments. Specifically, FIGS. 4*a* and 4*b* show the system of FIG. 3 after the casing string (106) has been lowered to the designated depth. Components of FIGS. 4*a* and 4*b* that are the same as or similar to components depicted in FIGS. 1-3 have not been redescribed for purposes of readability and have the same functions as described above.

FIG. 4*a* shows a stinger (400) deployed into the casing string (106) on a deployment device. The deployment device may be drill pipe (402) as shown in FIGS. 4*a* and 4*b*. In FIG. 4*a*, the casing string (106) has been lowered to the setting depth and the stinger (400) has been lowered into the flow control apparatus (200), just above (i.e., closer to the surface location (104)) the disk (222). The stinger (400) has a bottom end (404) with an outer diameter smaller than the diameter of the conduit (206) of the flow control apparatus (200) so that the stinger (400) may fit within the flow control apparatus (200). The stinger (400) applies the pre-determined force to the disk (222) to break the disk (222) and allow a flow of fluid (116) to flow in the second direction (216) from the stinger (400) to the annulus (110). In accordance with other embodiments, the disk (222) may be broken by applying a hydraulic pressure onto the disk (222) using a fluid (116). The disk (222) is designed to break into very small pieces that are able to be circulated out of the well (100).

FIG. 4*b* shows the system after the disk (222) has been broken by the stinger (400) or by the hydraulic pressure. Fluid (116) is shown as being able to flow in the second direction (216). The bottom end (404) of the stinger (400) may have a plurality of seals (406) disposed circumferentially around the stinger (400). The seals (406) create a fluid tight seal between the tubular inner circumferential surface (212) and the stinger (400). This allows for cement, as the fluid (116), to be pumped, in the second direction (216), from surface location (104), through the drill pipe (402)/stinger (400)/flow control apparatus (200), and into the annulus (110) to cement the casing string (106) in place.

While FIGS. 3, 4*a*, and 4*b* show the flow control apparatus (200) acting as the float shoe (112), the flow control apparatus (200) may be installed in the casing string (106) by connecting the first end (208) and the second end (210) to the casing string (106) so that the flow control apparatus (200) may act as the float collar (118) without departing from the scope of this disclosure herein.

Figure 5:
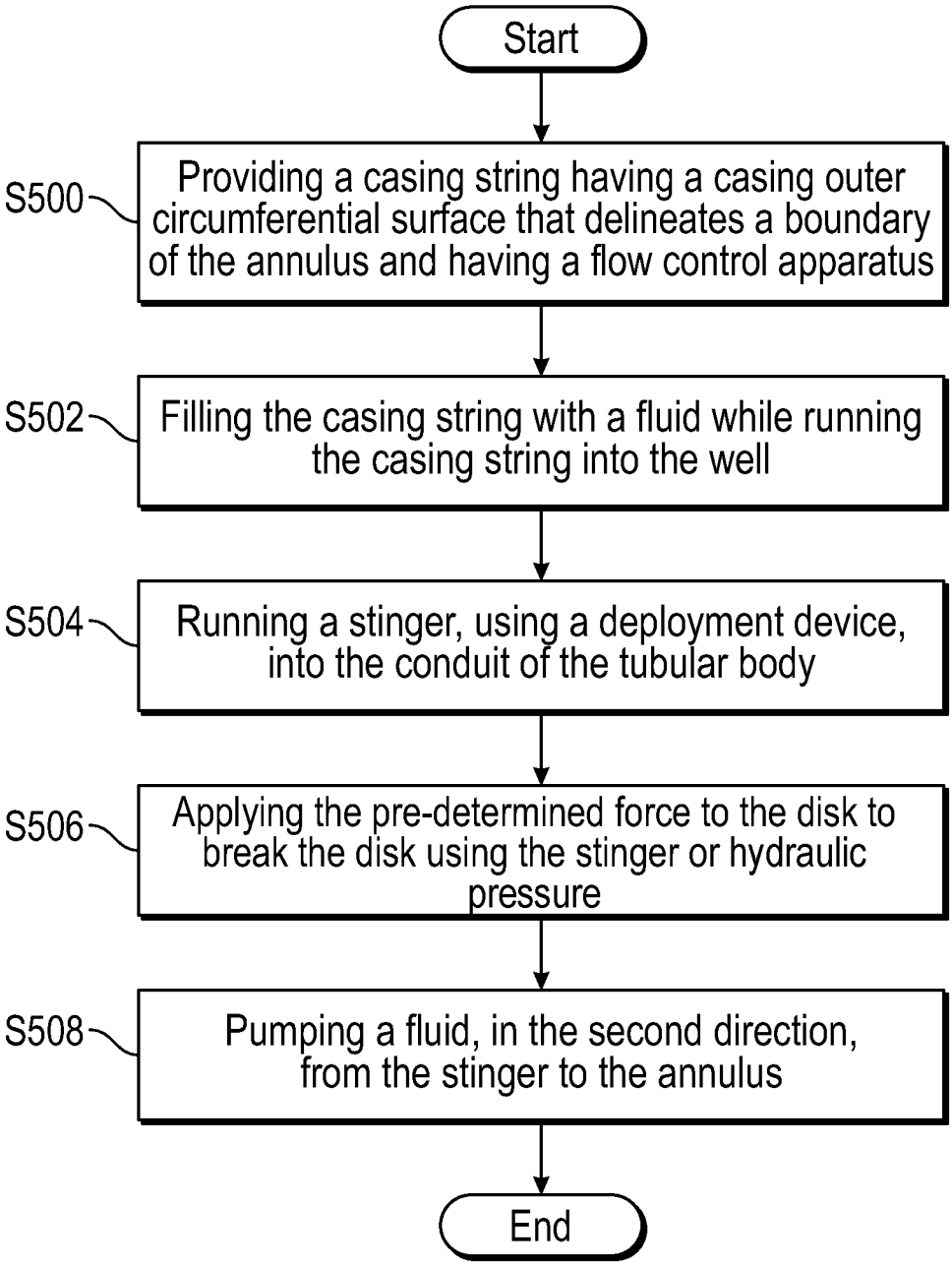
FIG. 5 shows a flowchart in accordance with one or more embodiments.

FIG. 5 depicts a flowchart in accordance with one or more embodiments. Specifically, the flowchart illustrates a method for placing a fluid (116) in an annulus (110) of a well (100). Further, one or more blocks in FIG. 5 may be performed by one or more components as described in FIGS. 1-4*b*. While the various blocks in FIG. 5 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

Initially, a casing string (106) having a casing outer circumferential surface (108) that delineates a boundary of the annulus (110) is provided. The casing string (106) includes a flow control apparatus (200) (S500). The flow control apparatus (200) is a tubular body (202) having a first end (208) and a second end (210). A conduit (206) runs through the tubular body (202) and extends from the first end (208) to the second end (210). A float valve (114) is installed in the conduit (206) to prevent a flow of fluid (116) in a first direction (214). The first direction (214) being from the second end (210) of the tubular body (202) to the first end (208) of the tubular body (202).

A disk (222) is installed across the conduit (206) to also prevent a flow of fluid (116) in a second direction (216). The second direction (216) being from the first end (208) of the tubular body (202) to the second end (210) of the tubular body (202). The disk (222) is designed to be broken when a pre-determined force is exerted on the disk (222). When the disk (222) is broken, fluid (116) is permitted to flow in the second direction (216). In one or more embodiments, the disk is made of a ceramic material.

The flow control apparatus (200) is installed in the casing string (106) by forming a first connection between the first end (208) and the casing string (106). Forming the first connection includes threading the first end (208) into a first joint of the casing string (106). In other embodiments, the flow control apparatus (200) is installed in the casing string (106) by forming the first connection and forming a second connection between the second end (210) and the casing string (106). Forming the second connection includes threading the second end (210) into a second joint of the casing string (106).

The casing string (106) is filled with a fluid (116) while the casing string (106) is run into the well (100) (S502). Because of the presence of the disk (222) in the flow control apparatus (200), the fluid (116) is unable to escape the casing string (106) into the annulus (110). Thus, the fluid (116) may completely fill the inside of the casing string (106), increasing the weight of the casing string (106) to overcome the buoyancy force exerted by the fluid (116) that is already located in the wellbore (102). The casing string (106) may be lowered to a pre-determined setting depth due to overcoming the buoyancy force.

A stinger (400) is run into the conduit (206) of the tubular body (202) using a deployment device (S504). The deployment device may be a drill string made of drill pipe (402). A pre-determined force is applied to the disk (222) to break the disk (222) using the stinger (400) or a hydraulic pressure (S506). After the disk (222) is broken, the stinger (400) may be lowered further into the conduit (206) to form a fluid-tight seal between the tubular inner circumferential surface (212) and the stinger (400) using seals (406) disposed circumferentially around the stinger (400).

A fluid (116) is pumped, from the surface location (104) through a channel in the deployment device. The channel transports the fluid (116) to the stinger (400). The fluid (116) is pumped in the second direction (216) from the stinger (400) to the annulus (110) (S508) through the flow control apparatus (200). The casing string (106) may be cemented in place by pumping cement as the fluid (116). The cement may be led and/or followed by a cement plug that may seat within the flow control apparatus (200). The cement plug may also seat within a float collar (118) located above (i.e., closer to the surface location (104)) the flow control apparatus (200).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A system for placing a fluid in an annulus, the system comprising:

a casing string with a casing outer circumferential surface, wherein the casing outer circumferential surface delineates a boundary of the annulus;

a flow control apparatus comprising:

a tubular body having a conduit delineated by a tubular inner circumferential surface, a first end, and a second end, wherein the first end is connectable to the casing string and the conduit comprises a hydraulic connection with the annulus in a second direction, a float valve, fixed within the conduit of the tubular body, configured to block flow in a first direction and allow flow in the second direction, and a disk, fixed above the float valve and within the conduit of the tubular body, configured to prevent flow in the second direction until the disk is broken by a pre-determined force; and a stinger, deployed in the casing string by a deployment device, having a bottom end with an outer diameter smaller than a diameter of the conduit, wherein the stinger applies the pre-determined force to the disk to allow a flow of the fluid, in the second direction, from the stinger to the annulus.

2. The system of claim 1, wherein the second end is connectable to the casing string.

3. The system of claim 2, wherein the first end and the second end are connectable to the casing string by a thread-able connection.

4. The system of claim 1, wherein the second end further comprises a casing guide.

5. The system of claim 4, wherein the first end is connectable to the casing string by a thread-able connection.

6. The system of claim 1, wherein the disk is made of a ceramic material.

7. The system of claim 1, wherein the tubular body, the float valve, and the disk are made of a drillable material.

8. The system of claim 1, wherein the stinger comprises a plurality of seals disposed circumferentially around the stinger.

9. The system of claim 8, wherein the plurality of seals create a fluid-tight seal between the tubular inner circumferential surface and the stinger.

10. The system of claim 1, wherein the deployment device further comprises drill pipe having a channel configured to transport the fluid from a surface location, through the drill pipe, and to the stinger.

11. A method for placing a fluid in an annulus of a well, the method comprising:

providing a casing string having a casing outer circumferential surface that delineates a boundary of the annulus, wherein the casing string further comprises a flow control apparatus having:

a tubular body having a conduit delineated by a tubular inner circumferential surface, a first end, and a second end, wherein the first end is connectable to the casing string and the conduit comprises a hydraulic connection with the annulus in a second direction;

a float valve, fixed within the conduit of the tubular body, configured to block flow in a first direction and allow flow in the second direction;

a disk, fixed above the float valve and within the conduit of the tubular body, configured to prevent flow in the second direction until the disk is broken by a pre-determined force;

filling the casing string with a fluid while running the casing string into the well;

running a stinger, using a deployment device, into the conduit of the tubular body;

applying the pre-determined force to the disk to break the disk using the stinger; and pumping a fluid, in the second direction, from the stinger to the annulus.

12. The method of claim 11, wherein providing the casing string further comprises forming a first connection between the first end and the casing string.

13. The method of claim 12, wherein forming the first connection further comprises threading the first end into a first joint of the casing string.

14. The method of claim 13, wherein providing the casing string further comprises forming a second connection between the second end and the casing string.

15. The method of claim 14, wherein forming the second connection further comprises threading the second end into a second joint of the casing string.

16. The method of claim 11, wherein the disk is made of a ceramic material.

17. The method of claim 11, wherein the tubular body, the float valve, and the disk are made of a drillable material.

18. The method of claim 11, wherein running the stinger into the conduit of the tubular body further comprises forming a fluid-tight seal between the tubular inner circumferential surface and the stinger using seals disposed circumferentially around the stinger.

19. The method of claim 18, wherein pumping the fluid, in the second direction, from the stinger to the annulus further comprises pumping the fluid from a surface location through a channel in the deployment device to the stinger.

20. The method of claim 19, wherein pumping the fluid, in the second direction, from the stinger to the annulus further comprises cementing the casing string in place by pumping cement as the fluid.

* * * * *